United States Patent [19]

Krogseng et al.

[11] 4,319,623

[45] Mar. 16, 1982

[54] WINDOW STRUCTURE INCLUDING A SHEET OF POLYMERIC FILM

[75] Inventors: Gerald P. Krogseng, Oakdale; Joseph G. Mandell, St. Paul; George L. Ruth, Stillwater, all of Minn.

[73] Assignee: Minnesota Mining and Manufacturing Company, St. Paul, Minn.

[21] Appl. No.: 112,119

[22] Filed: Jan. 14, 1980

[51] Int. Cl.[3] ..... A47H 23/00; A47H 13/00

[52] U.S. Cl. ..... 160/90; 160/329; 160/391

[58] Field of Search ..... 160/368 R, 90, 101, 160/108, 107, 329, 328, 327, 383, 403, 391, 392, 394, 395, 400

[56] References Cited

U.S. PATENT DOCUMENTS

| | | | |
|---|---|---|---|
| 903,500 | 11/1908 | Pinkham | 160/394 X |
| 1,067,075 | 7/1913 | Swanson | 160/391 UX |
| 1,798,833 | 3/1931 | Campbell, Jr. | 160/327 |
| 2,519,998 | 8/1950 | Burns | 160/329 |
| 2,732,895 | 1/1956 | Steiner | 160/329 |
| 2,849,762 | 9/1958 | McCarthy | 160/90 X |
| 2,877,516 | 3/1959 | Bobel | 160/392 X |
| 3,805,873 | 4/1974 | Bloomfield | 160/395 X |
| 3,991,806 | 11/1976 | Abell | 160/90 |
| 4,133,366 | 1/1979 | Jenkins, Sr. | 160/328 |
| 4,164,105 | 8/1979 | Herbst et al. | 160/394 X |

*Primary Examiner*—Philip C. Kannan

*Attorney, Agent, or Firm*—Cruzan Alexander; Donald M. Sell; Randall J. Gort

[57] ABSTRACT

A window structure having a film supported optically flat between panes of glass, with the film secured at two opposing ends by a strip of metal grasping the film. The strip is held in a retainer resiliently secured in the glazing channel of the window. The glazing frame also includes side pieces and corner keys which support the opposed channels in spaced fixed relationship.

11 Claims, 6 Drawing Figures

WINDOW STRUCTURE INCLUDING A SHEET OF POLYMERIC FILM

BACKGROUND OF THE INVENTION

This invention relates to a window structure including a support for a flexible sheet of polymeric film to maintain the film in a planar configuration between a pair of opposed and spaced frame channels separating two panes of glass.

There have been triple pane windows to reduce heat loss but the present invention proposes the placement of a rectangular film between the panes of glass. The film will form an additional dead air space and further may be coated to vary the transmission characteristics for radiation of certain wavelengths. It is desirable that the support for the film occupy as narrow an area as the conventional frame spacing between the panes of glass in the dual pane window. It is essential to the aesthetics and to the use of the window that the film be optically planar. The present invention thus provides a window structure with the film supported in an optically planar configuration and provides a light weight, energy efficient structure which can be tailored to the desired energy transmission characteristics.

Prior to this invention there were structures for supporting flexible material such as metal or plastic screens, trampoline canvases, draperies, sign panels, etc. These structures typically fasten the material by connecting the material to the frame at intervals along its edges. These structures also exemplify uses of a supported sheet in which there is no concern for maintaining the supported sheet in an optically planar configuration. In some situations the natural configuration of the supported sheet as it hangs is adequate. Other situations utilize the natural tendency for the filaments within the fibrous material to slip with respect to each other and thus compensate for the applied stresses at the fastening points. This type of compensation cannot occur, however, with amorphous structures such as oriented polymeric films with which the stress areas are retained in the sheet and not compensated for by the change in the sheet structure. Thus, when the amorphous material is stretched across a surface and held within a slot by a rigid clip, or when the edge is secured at intervals with eyelets or other fasteners, little compensation for dimensional changes occurs and wrinkles will appear in the structure where pressure points exists. These wrinkles are very undesirable in a window and cause distortion. The need for a fastening structure to maintain a film between the glass panes in an optically planar or flat configuration for extended periods and numerous temperature cyclings was apparent. The solution however was difficult especially when the supported films were to be used within a large window or door assembly.

SUMMARY OF THE INVENTION

This invention is related to a novel window structure and in one aspect to a mechanical suspension system for supporting a polymeric film under tension in an optically planar configuration, capable of withstanding the temperature changes and stresses to which it might be environmentally subjected while still retaining its optical clarity and aesthetic appearance.

The particular structure employed comprises means for separately grasping the opposing edges of the film so as to continually secure the film along the entire length of these opposing edges. This is especially important due to the unforgiving nature of polymeric film when exposed to discrete points of stress. Since these grasping means ultimately determine the plane to be assumed by the supported film, a large degree of precision is required when forming the grasping means and when securing the film to the grasping means. This requirement for precision necessitates utilizing a grasping means which is easily workable, i.e., thin stock which can be formed with minimal forces. The use of thin stock for the grasping means does not, however, provide a member strong enough to restrain the applied forces on the supported film from bending or otherwise distorting the grasping means. For this reason, a rigid retainer is disposed adjacent the grasping means along each of the film's opposed and supported edges. The retainer is adapted to receive and support the grasping means along its entire length, hold it in a plane and generally in a linear path in said plane and place a bias on said grasping means for tensioning said film to hold it in a plane between the channels. The biasing means are affixed to a frame channel such as the glazing channel which spaces the panes of glass in a sealed double glazed window. Continuously grasping and resiliently supporting the film only along its two opposing edges as described above, results in a free floating structure allowing the film to move freely in an oriented direction so as to continuously compensate for long-term temperature cycling as well as any changes in the film's elasticity. The biasing means are joined to the retainer by being integral with the retainer or by being fastened between the retainer means and the frame channels. These separate biasing means are disposed at predetermined intervals either between the frame channels and the retainer or between a planar surface on the channel and the receptacle of the retainer which supports the grasping means. The biasing means compensate for any dimensional changes which occur in the frame channels and prevent these dimensional changes from being transmitted to the film through the retainer and grasping means of this supporting structure. The frame channels are supported at their ends and spaced from each other by extruded frame side pieces or roll formed material which are generally filled with a desiccant.

DESCRIPTION OF THE DRAWING

The present invention will be further described hereinafter with reference to the accompanying drawing wherein.

DESCRIPTION OF THE PREFERRED EMBODIMENT

Figures 1, 2:
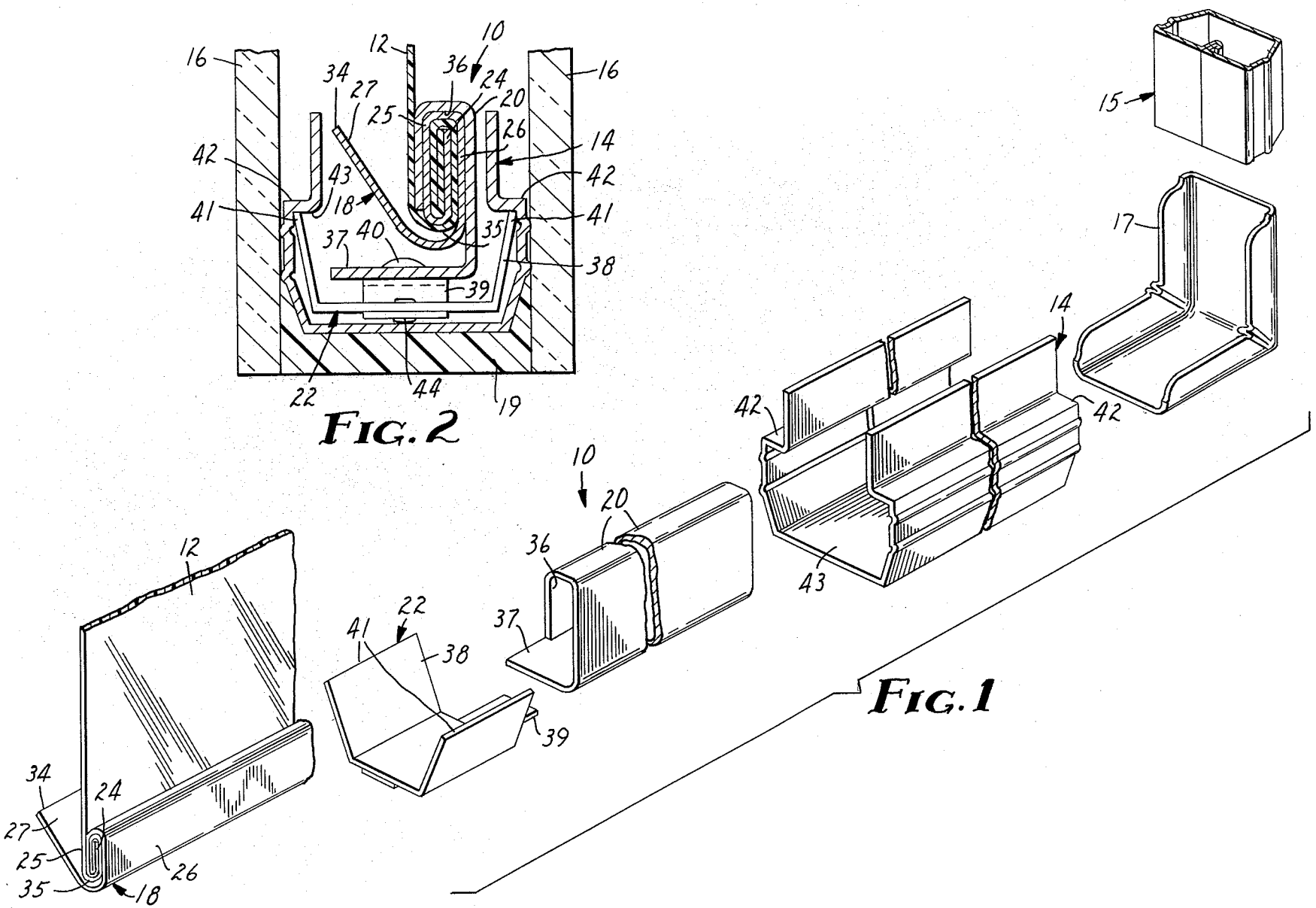
FIG. 1 is an expanded perspective view illustrating the elements of one embodiment of a film supporting structure according to the present invention.
FIG. 2 is an enlarged transverse sectional view of the assembled structure of FIG. 1 between the panes for a window or door.

The support structure 10 of the present invention is most clearly illustrated in FIGS. 1 and 2 of the drawing. This structure 10 is designed to support a sheet of polymeric film 12 between a pair of opposed and spaced (upper and lower) frame channels 14 (only one end is illustrated the other end being identical). The frame channels 14 and spaced cooperating side pieces 15 generally form the spacers located between the glass panes 16 of a sealed multi-glazed window. The end channels and metal side pieces 15 are easily assembled by corner keys or clips 17. The side pieces 15 are filled with desiccant. For applications of the film supporting structure with windows it is important that the structure 10 cooperate with the type of frame channel illustrated because of its proven sealing ability within the glass glazing industry. The window is then sealed about its peripheral edge by a polysulfide sealant or similar material 19 which seals and bonds the panes 16 together.

The support structure 10 comprises a film edge strip 18 on each end of the two opposing ends of a polymeric film 12. These edge strips 18 are further supported by a pair of rigid retainers 20 which are designed to be attached to the opposed frame channels 14. Biasing means 22 are included to compensate for dimensional changes occuring in the film and the frame channels 14, and to prevent these changes from rippling or distorting the supported film 12.

The film edge strips 18 provide a means for grasping the edges of the film 12. It is critical that the proper alignment of the film edge strips 18 with the film 12 be obtained. Imperfections in this alignment will result in a non-optically planar film suspension, e.g., ripples will result in the film 12. Preferably, a flat edge is provided around or against which the film 12 is supported. This is desired because any imperfections in the flatness over the length of the edge strips 18 will result in the appearance of ripples within the film 12. Also, to maintain the film flat and restrict ripples appearing during temperature fluctuations, the coefficient of expansion of the material of the edge strip and of the film should be matched as closely as possible. For these reasons, a thin section of steel sheet stock; e.g. a stock having a thickness in the range of 0.15 mm–0.28 mm is utilized. The use of this thin stock also enables a standard sheet metal brake press to be utilized in forming the stock and film edge to provide the desired grasping means. The film edge strip 18 is aligned to be parallel with the film edge and then attached to the film edge, e.g. by conventional adhesive or tape means. Care is taken to ensure that the film 12 is continuously attached to the edge strip 18 so that discontinuous points of stress will not occur. The metal stock is then crimped as is illustrated in FIG. 2, i.e., the strip 18 having a first portion 24 fastened to the film 12 is folded over the film 12 resulting in an edge of the film 12 being layered between one face of the first portion 24 and a second portion 25 of the strip 18, thus forming a first crimp. The film 12 and the strip 18 are then folded again so as to be adjacent the opposite face of the first portion 24 of the strip 18, resulting in the second crimp with the film 12 passing between the first portion 24 and a third portion 26 of the strip 18. A final and partial fold is then made, resulting in a fourth portion 27 of the strip 18 extending obliquely from the second portion 25 of the strip 18. The film 12 passes between this fourth portion 27 and the second portion 25 and around the smooth edge of the first fold. This manner of crimping the strip 18 provides increased grasping of the film 12 and results in a greater longevity of the grasping means than would be possible by strictly gluing or taping a film to a glazing member. It also maintains the alignment and flatness of the film as required by such optically oriented applications.

Figure 5:
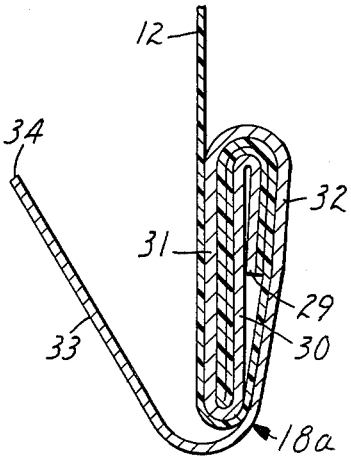
FIG. 5 illustrates an alternate construction of the edge strip of the present invention.

An alternate construction for the film edge strip 18 is illustrated in FIG. 5. In this construction the film 12 is attached to a first portion 29 of an edge strip **18*a*. The first fold of the edge strip 18*a* is made in the opposite direction of that shown in FIG. 2 resulting in the first portion 29 of the edge strip 18*a* being directly adjacent a second portion 30 of the edge strip 18*a* with the film 12 passing exterior to the fold. A second fold of the edge strip 18*a* is then made causing a third portion 31 of the strip 18*a* to pass adjacent the second portion 30, with the film 12 interposed between the second 30 and third 31 portions causing it to be sandwiched back or folded over upon itself. A third fold is then made around the first fold resulting in the sandwiched layers of the film 12 passing between the first portion 29 and a fourth portion 32. A fourth and partial fold is made around the second fold resulting in a fifth portion 33 of the strip 18*a* extending obliquely from the third portion 31 with a single layer of film 12** therebetween and contacting a flat surface of the strip. In practice the second fold is made first and then the first and third folds are made in the same operation to assure optimum tightness and uniformity of the film to metal and film to film interfaces.

Figure 3:
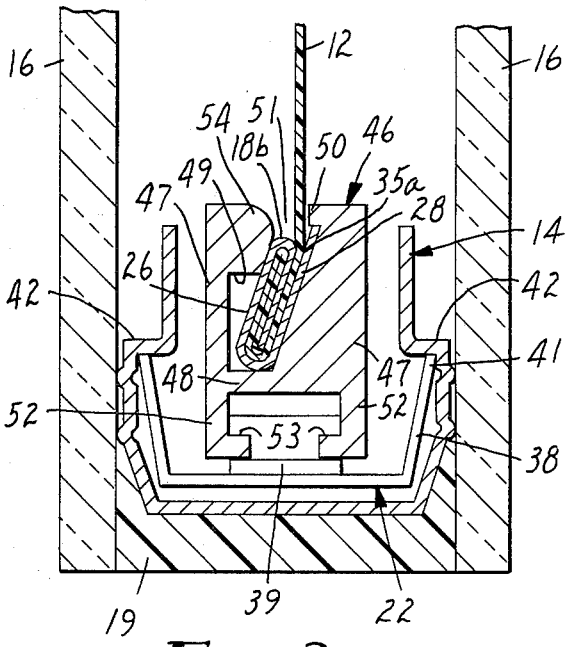
FIGS. 3 and 4 illustrate alternate embodiments of the present invention.
Figure 4:
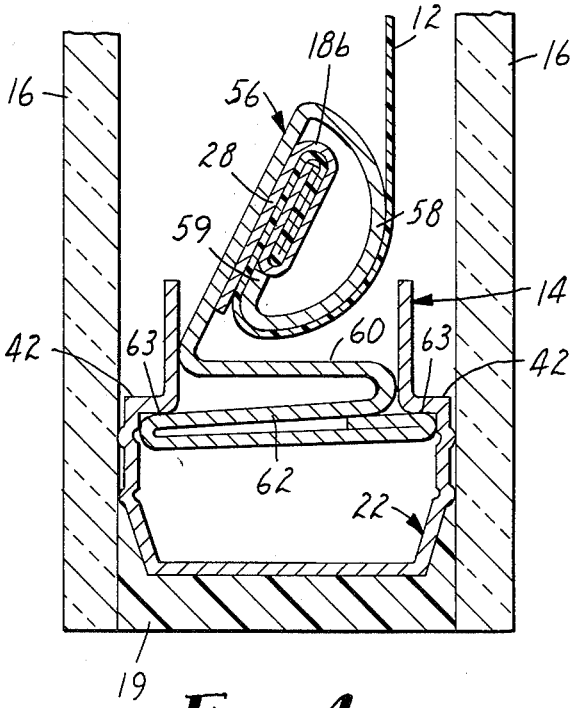

In both of these embodiments (FIGS. 2 & 5), the distal portions 27 (FIG. 2) or 33 (FIG. 5) of the film edge strip 18 or **18*a* project obliquely to the remaining portions of the strip 18 or 18*a* such that the distal end 34 of those portions 27 and 33 is spaced from the film 12. This is a result of the necessity for providing guidance for the film 12 during the assembly of these embodiments. As illustrated in FIGS. 3 and 4 it is also possible to utilize an edge strip 18*b*, similar to the strip 18, where this last or distal portion 28 projects parallel to the other portions so as to parallel the exiting film 12**.

As illustrated in FIG. 2 the film edge strip 18 with the edge of the film 12 is inserted into a retainer 20 designed to support the edge strip in a plane and generally in a linear path in the plane to support one edge of the film. The retainer 20 as illustrated in FIGS. 1 and 2 is formed from a thicker section of flat galvanized steel stock, e.g. 1.5 mm thickness. Alternate thicknesses however could be used depending upon the structural properties of the material employed. The retainer 20 comprises a first part having portions defining a receptacle 36 having a generally inverted U-shaped cross-section. This receptacle 36 is adapted to receive and rigidly support the film edge strip 18 against bending or bowing along its entire length. As previously mentioned, the thin stock used to form the grasping means is generally not strong enough to withstand the tensioning forces present in the supporting structure (e.g. in the range of 100 to 360 grams per lineal centimeter of film width). For this reason, the rigidity of the retainer 20 is used to supplement the strength of the edge strips 18, **18*a* or 18*b***.

As illustrated the retainer 20 has portions defining a surface 37 which defines a plane which is substantially parallel to the supported film edge 35 when the edge strip 18 has been inserted into the receptacle 36. This alignment of the surface 37 and the film edge 35 allows the surface 37 to be utilized to position the supporting structure 10 and the film 12 with respect to the spaced frame channels 14.

Biasing means assist in this interaction between the frame channels 14 and the retainers 20. In FIGS. 1 and 2, the biasing means 22 comprise a plurality of spaced structures each including a bracket 38 and a flat bar or leaf spring 39. The bracket 38 has a body portion the distal edges 41 of which are adapted to contact inwardly-extending or shoulder portions 42 of the frame channel 14. The bracket 38 is inserted into the chamber 43 generally defined by the wall members of the frame channel 14. The leaf spring 38 is affixed longitudinally along the body portion of the bracket 38 by means such as spot welding 44. The distal or free end of the bar spring 39 is attached to the rigid retainer 20 by fastening means 40, such as rivets or bolts (See FIG. 2). Alternatively, this distal end can be adapted to engage ears such as illustrated at 53 on the retainer 46 (See FIG. 3) by the formation of recesses 40*a* as in FIG. 6 wherein the member 22 is formed from one piece of spring stock. Both of these fastening methods result in the resilient fastening of the retainer to the frame channel 14. In this manner, the retainer 20, the edge strip 18, and supported film 12, can be biased with respect to the frame channels 14 so as to tension the film 12 and provide compensation for any dimensional changes occuring within the channels 14 as e.g. due to the temperature cycling. The spring structures 22 allow these dimensional changes to occur without disturbing the optically planar position of the film. Several of the biasing structures 22 are spaced at predetermined intervals along the length of the retainer 20. As an example a typical arrangement for a window having a width of 36 cm utilizes two biasing structures; each of which are fastened by means 40 or 40*a* to the retainer 20, 0.76 cm from the edges of the retainer 20 which are proximate to unsupported edges of the film 12. Larger applications may require additional numbers of biasing means 22 spaced between these biasing structures positioned adjacent the channel ends. These intermediate biasing means are also positioned experimentally.

Figure 6:
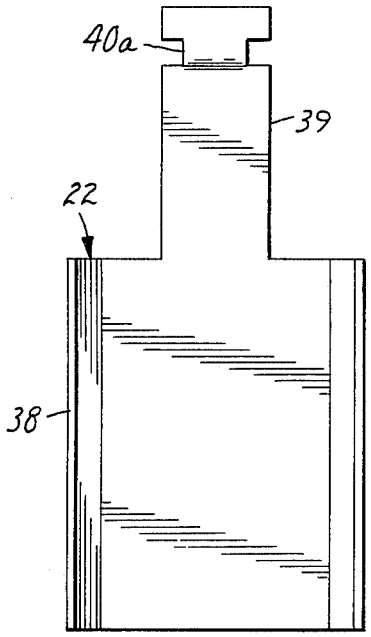
FIG. 6 is an enlarged view of one construction for the biasing means of the present invention.

An alternate embodiment to the present invention is illustrated in FIG. 3. In this alternate embodiment, an extruded aluminum retainer 46 having a generally H-shaped cross section has been substituted for the folded flat stock previously described as the retainer 20. The retainer 46 has an inwardly directed part with spaced legs 47 on one side of a cross member 48 shaped to define a supporting cavity or receptacle 49 to slidably receive the film grasping edge strip 18*b*. In this embodiment, the film edge strip 18*b* is insertable into the supporting cavity 49 with one portion 28 engaging and being held against a planar surface and the end of said portion 28 engages the underside of a projecting strip locating lip 50 to hold the strip 18*b* in a linear path. A projecting lip 54 on the other leg 47 engages portion 26 of the edge strip 18*b* so as to secure the film edge strip 18*b* within the cavity 49 against the planar surface. The film 12 is able to pass through an opening 51 within the extruded retainer 46. The retainer 46 also has a second outwardly directed part comprised of portions of another pair of legs 52 on the otherside of the cross member 48. The distal end of the legs 52 have inwardly projecting ears defining shoulder surfaces 53 which are substantially parallel to the film edge 35*a* and lip 50 when the edge strip 18*b* has been received within cavity 49. As with the previous embodiment, flat shoulder surfaces 53 cooperate with biasing means 22 as illustrated in FIG. 6 to secure the retainer 46 to the frame channels 14.

A third embodiment is illustrated in FIG. 4. In this embodiment the retainer and biasing means are integrated and a sheet of flat spring stock is formed to retain the edge strip and bias the same toward the end channel to maintain the film under tension. Thus, as formed a member 56 has a retainer portion 58, a biasing portion 60, and a channel engaging portion 62. The film edge strip 18*b* can be inserted endwise into the retaining receptacle 58 so as to be engaged by an inwardly projecting strip locating lip 59 on the distal end of the member 56 with a portion 28 held against a planar edge wall of the member. To form the receptacle 58 the stock is bent from the lip 59 to form an arcuate semicylindrical shape and then is bent again toward the lip 59 defining a planar cover across the semicylindrically shaped recess, but the cover is spaced from the lip 59 to provide an exit opening for the film 12. The stock is then folded below the opening across the width of the receptacle and is reversely folded to form a leg providing the inherent resilience for the biasing portion 60. The stock is then folded twice more to provide a base having two longitudinal flat surfaces 63, on the side adjacent the receptacle, projecting transversely beyond each side of the receptacle such that the flat surfaces 63 are generally parallel to the lip 59 and engage the shoulders 42 on frame channel 14 to position the member 56 with respect to the frame channel 14. The film 12 exits the receptacle and passes around an arcuate portion of the member 56 forming the receptacle to provide a flat smoothing surface.

A critical aspect of this invention is the characteristic of the film 12 which is supported by the resilient holding structures. Since one object of this invention is to achieve an optically flat surface, it is required that a high quality, uniformly thick, high tensile strength film be utilized. The shrinkage characteristics of this film are also a limiting factor. It has been experimentally determined that a polyester film having a thickness in the range of 0.05–0.10 millimeters and shrinkage characteristics of less than 0.2% at 150° C. in the transverse direction and less than 1.5% at 150° C. in the machine direction is preferred. The larger percentage shrinkage in the machine direction is allowable because of the compensation provided by the resilient supporting structures. The shrinkage characteristics, although critical in applications where the film 12 must undergo temperature extremes, do become less important where the film 12 can be maintained at or near normal ambient room temperatures. These film shrinkage characteristics can be obtained by techniques which are conventionally known within the film producing and treating industries.

It has also been found that subjecting the film to a heat treatment, i.e. heating the tensioned film for approximately 20 minutes in a 100 degree centigrade forced air oven, followed by a slow cool-down to ambient room temperatures, relieves some of the inherent stress characteristics which might exist in a commercially available film. As long as the film satisfies the above-mentioned shrinkage characteristics, this heat treatment has proven successful in helping to maintain a ripple-free supported film. It has also been found that films not meeting the shrinkage characteristics tend to be optically destroyed by the heat treatment process.

The film 12 may have various coatings to change the energy transmissive characteristics thereof. One coating which renders a surface of the film more light transmissive and less light reflecting is described in United States patent application Ser. No. 770,043 filed Feb. 18, 1977 by G. L. Dorer et al, assigned to the assignee of the invention. The coating described is produced by depositing a thin metal film on the film surface, totally converting the thin metallic film to either an oxide and/or hydroxide microstructured layer by a chemical or a combination of chemical and electrochemical methods.

Having thus described the preferred embodiment of the present invention, it is understood that changes may be made in the size, shape or configuration of some of the parts, without departing from the present invention as described in the appended claims. The rectangular film supporting frame may also have application with films for mirrors or to support thin flexible lenses where optical flatness is desired.

What is claimed is:

1. A structure for supporting a sheet of polymeric film between a pair of opposed and spaced frame channels comprising:

grasping means fastened to said film along two of its opposing edges for continuously securing said film along the entire length of said opposing edges, retainer means having portions defining a receptacle to receive and support each of said grasping means along its entire length for holding said grasping means in a plane and generally in a linear path in said plane and for providing rigidity to said grasping means, and biasing means joined to said retainer means and adapted for attachment to said channels for tensioning said film between said spaced channels and to compensate for dimensional changes occurring between said film and said channels to maintain the film flat.

2. A structure as claimed in claim 1 wherein said means for grasping said film comprises a folded strip of metal material having a first portion which is fastened to said film, and having a second portion folded over said film along the attachment between said film and said first portion, wherein said film is folded over so as to be between said first portion and said second portion; said strip having a third portion folded over said first portion, and having a fourth portion folding said film adjacent said second portion.

3. A structure as claimed in claim 2 wherein the distal end of said fourth portion is spaced from said film.

4. A structure as claimed in claim 1 wherein said retainer means is an extrusion and comprises two legs and an interconnecting cross member and wherein said receptacle is comprised of portions of said legs on a first side of said cross member to form a locating edge for said grasping means and said portions of said legs on a second side of said cross member are formed with ears defining a surface which is substantially parallel to said film edges.

5. A structure as claimed in claim 1 wherein said biasing means comprises a bracket having a body portion and distal ends adapted to contact said frame channel, a flat bar spring fastened longitudinally along said body portion and extending beyond said bracket, and fastening means adapted to fasten said bar spring to said retainer.

6. A structure as claimed in claim 1 wherein said means for grasping said film comprises a folded strip of sheet steel having a first portion which is fastened to said film edge and having a second portion folded over adjacent said first portion, said film passing exterior to the fold, and having a third portion folded back upon said second portion with said film being folded over upon itself and interposed between said second and third portions, and having a fourth portion folded over said fold line and adjacent said first portion with said film continuing therebetween, and having a fifth portion adjacent said third portion with said film continuing therebetween.

7. A window structure for improved radiation transmission for energy saving comprising a pair of spaced rectangular panes of glass, a frame spacing said panes and comprising a pair of opposed channel members opening toward each other a rectangular sheet of polymeric film, strip means for grasping said film along two of its opposing edges so as to continuously secure said film along the entire length of said opposing edges, and means for resiliently retaining said strip means at said two opposing edges of said film adjacent said channel member and for placing said film between said strips in tension and maintain it in an optically flat plane spaced between said panes of glass.

8. A structure as claimed in claim 7 wherein said strip means for grasping said film comprises a strip of sheet material having a first portion which is fastenable to said film by conventional adhesive means, and having a second portion folded over said film along the area of attachment between said film and said first portion, wherein said film is folded over so as to be between said first portion and said second portion; and said strip means having a third portion folded over said first portion.

9. A structure as claimed in claim 8 wherein the distal end of said fourth portion is spaced from said film.

10. A structure as claimed in claim 7 wherein said means for resiliently retaining said strip means comprises a member having a longitudinal receptacle slidably receiving said strip means and biasing means for urging said strip means toward said channel members for tensioning said film.

11. A frame structure for use in supporting a sheet of flexible polymeric material under continuous tension in an optically flat plane, said frame structure comprising at least two strips of metal each having a plurality of longitudinal axes about which said strip is folded, said strips being adapted when folded to receive opposing edges respectively of the polymeric material, and grasp the opposing edges of the polymeric material therein, retainer means for slidably receiving and supporting said folded metal strips and the edges of the polymeric material therein, and for defining a plane in which said strips are to be placed, said retainer means including spring means for tensioning the polymeric material, frame channel means having a width corresponding to the width of the polymeric material and at least one protruding lip having a surface adapted to engage and support said retainer means while permitting flexure of said spring means, side pieces having a predetermined length for spacing said frame channel means a predetermined distance, and corner clips adapted to slidably engage said frame channel means and said side pieces at their distal ends thereby connecting and retaining said frame channel means and said side pieces in assembled and generally rectangular orientation.

* * * * *